United States Patent [19]

Lum

[11] Patent Number: 4,580,695

[45] Date of Patent: Apr. 8, 1986

[54] PORTA TOWEL

[76] Inventor: Thomas Y. J. Lum, 1452 Kaminaka Dr., Honolulu, Hi. 96816

[21] Appl. No.: 655,100

[22] Filed: Sep. 27, 1984

[51] Int. Cl.[4] ..... A47K 10/24; B65H 1/08; B65H 19/00; B65D 1/34

[52] U.S. Cl. ..... 221/52; 221/56; 312/37; 312/61; 206/494; 206/556; 211/51

[58] Field of Search ..... 221/33, 47, 62, 53–56, 221/48, 26, 255, 259; 312/37, 71, 61, 193; 211/51; 206/449, 494, 556; D7/72

[56] References Cited

U.S. PATENT DOCUMENTS

| | | | |
|---|---|---|---|
| 205,841 | 7/1878 | Dawson | 221/56 X |
| 277,170 | 5/1883 | Smith | 211/51 |
| 1,464,180 | 8/1923 | Hudson | 221/48 |
| 1,511,812 | 10/1924 | Horwitt | 211/51 |
| 1,587,463 | 6/1926 | Arms | 221/52 |
| 1,603,714 | 10/1926 | Rappleye | 221/48 |
| 1,937,960 | 12/1933 | Hummel | 221/305 X |
| 2,278,011 | 3/1942 | Murdock | 211/51 X |

*Primary Examiner*—Joseph J. Rolla
*Assistant Examiner*—Gregory L. Huson
*Attorney, Agent, or Firm*—Richard L. Miller

[57] ABSTRACT

A portable towel dispenser that dispenses towels from an open top portion of a hollow rectangular shaped container. A slider is provided with a retainer portion for holding the towels down and a lifter portion for successively lifting each towel. Further provided on the slider is two parallel spaced plates forming a groove therebetween which fits in a slot in the front wall of the container and is vertically displaceable through a plurality of positions. Due to the binding action of the plates on the edges of the slot when the container is turned over, the towels will not fall out of the container when it is turned over.

2 Claims, 4 Drawing Figures

PORTA TOWEL

BACKGROUND OF THE INVENTION

The present invention relates to a towel dispenser. More particularly, it relates to a towel dispenser that is portable.

Towel dispensers of the above-mentioned general type are known in the art. For example, U.S. Pat. No. 1,464,180 to Hudson teaches a napkin dispensing device containing a freely removable gravity actuated plate utilized to retain the napkins in the device. This plate would not retain the napkins in the device, if the device were accidently turned over. Another example, U.S. Pat. No. 1,603,714 to Rappleye teaches a container for paper napkins and the like which is complex in construction and contains a plurality of hinged portions and elements. A final example, U.S. Pat. No. 1,937,960 to Hummel teaches a paper towel dispenser which is not adaptable for refilling.

SUMMARY OF THE INVENTION

Accordingly, it is the primary object of the present invention to provide a towel dispenser which avoids the disadvantages of the prior art.

It is another object of the present invention to provide a towel dispenser that is portable and can be used anywhere such as on picnics, patios, and remote job sites.

It is still another object of the present invention to provide a towel dispenser that is refillable.

It is yet another object of the present invention to provide a towel dispenser whose towels will not fall out when it is accidently turned over or exposed to wind.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appened claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
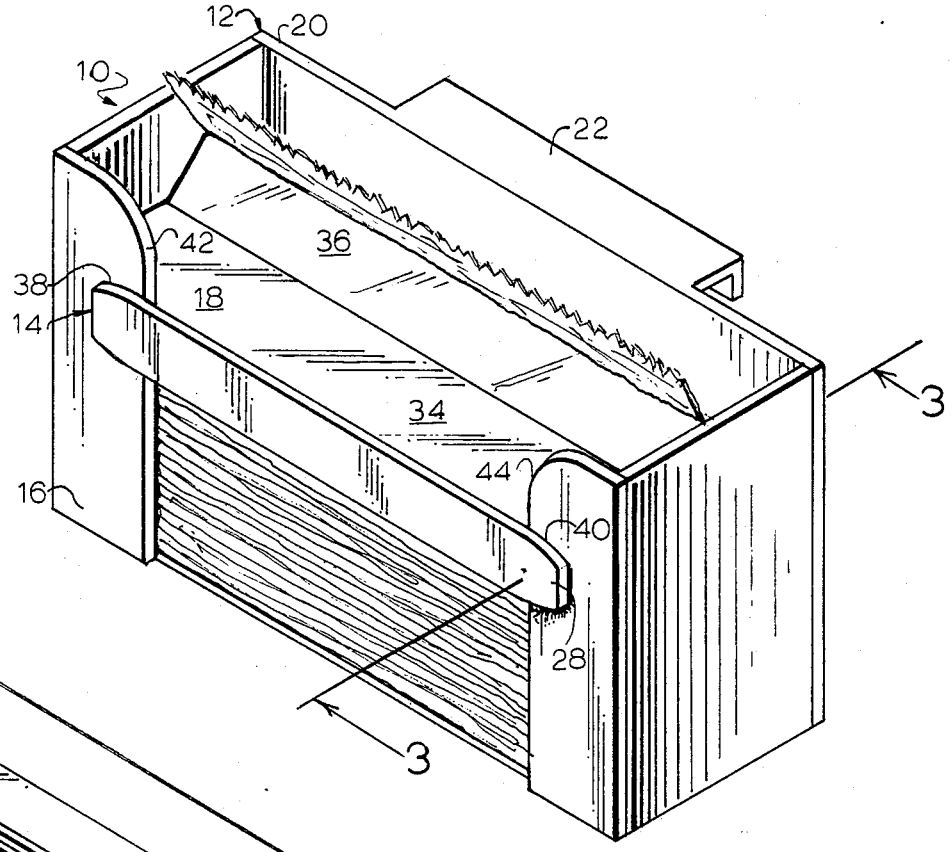
FIG. 1 is a perspective view of the invention.

Referring now to FIG. 1, the porta towel of the present invention is shown generally at 10 and includes a container 12 and a hold down/lifter 14. The porta towel 10 can be made of plastic in colors to match home decors. The container 12 is formed as a hollow open topped rectangular box having a front wall 16 containing a slot 18. The container 12 has a rear wall 20 with a handle 22 attached thereto so as to make the porta towel portably attachable. The hold down/lifter 14 fits into the slot 18 of the front face 16 and is vertically displaceable through a plurality of positions. Interfolded towels 24 are disposed in the interior of the container 12.

Figure 4:
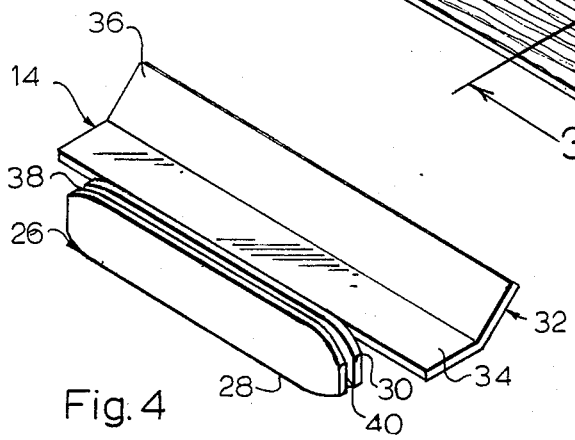
FIG. 4 is a perspective view of the slider.

The hold down/lifter 14, as shown in FIG. 4, includes a channel portion 26 made from two parallel plates 28 and 30. Attached to the plate 30 is a lifter portion 32 formed from a horizontal portion 34 onto which is formed a slanted portion 36. Grooves 38 and 40 of the hold down/lifter 14 are received by edges 42 and 44, respectively, of the slot 18 contained in the front face 16 of the container 12 and allows the hold down/lifter 14 to displace vertically (FIG. 1). If the container 12 filled with the towels 24 were to be tipped over, the hold down/lifter 14 would prevent the towels 24 from falling out of the container 12 by the binding action of the grooves 38 and 40 on the edges 42 and 44 respectively.

Figure 2:
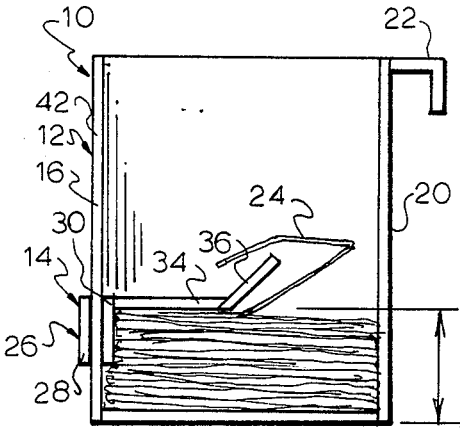
FIG. 2 is a cross sectional view taken on line 3—3 in FIG. 1.
Figure 3:
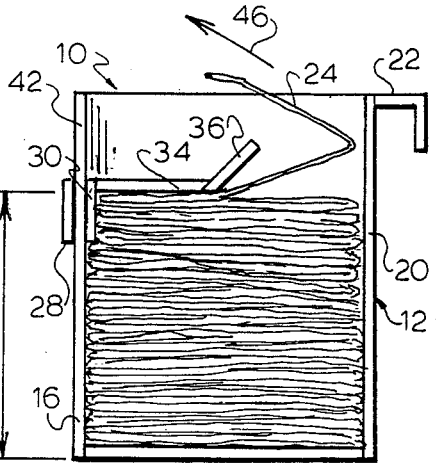
FIG. 3 is a similar view to that of FIG. 2 after additional towels have been added.

As shown in FIGS. 2 and 3, the horizontal portion 34 of the hold down/lifter 14 rests on and retains the towels 24 in their folded position. The slanted portion 36 of the hold down/lifter 14 receives the folded end portion of the towel 24 and lifts it in the direction of arrow 46. The towel 24 is removed through the open top portion of the hollow container 12 by pulling upwardly. The hold down/lifter 14 will then automatically lift the next towel 24 into a position to be used again.

Since the porta towel 12 is portable, it is convenient and can be used anywhere, such as on picnics, outdoor patios, and remote job sites. Additionally, the hold down/lifter 14 will prevent the wind from blowing the towels 24 away and is removable for filling the container 12 with the towels 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable towel dispenser for interfolded towels each having a flap section, comprising:

a hollow rectangular shaped container having a front wall containing a slot; and a slider being vertically displaceable in said slot of said front wall of said container and formed with a lifter portion for lifting the flap section of each of the interfolded towels as each of the interfolded towels is successively removed, and a retainer portion for retaining the interfolded towels in said container; wherein said slider further comprises two spaced parallel plates forming a groove therebetween and being attached to said retainer portion, said two parallel plates being vertically slidably displaceable in said slot of said front wall of said container and upon inversion of said container, said retainer portion is displaced by the weight of said towels causing a binding action of said parallel plates, whereby said towels are prevented from falling out of said container when said container is turned over.

2. The towel dispenser as defined in claim 1, wherein said slot is vertically defined by edges that slidably engage said grooves of said slider.

* * * * *